US007391375B1

(12) United States Patent
Lin et al.

(10) Patent No.: US 7,391,375 B1
(45) Date of Patent: Jun. 24, 2008

(54) MULTI-BAND ANTENNA

(75) Inventors: Ching-Chi Lin, Taipei Hsien (TW); Jia-Hung Su, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/675,803

(22) Filed: Feb. 16, 2007

(51) Int. Cl.
*H01Q 1/38* (2006.01)
*H01Q 1/24* (2006.01)
*H01Q 1/48* (2006.01)

(52) U.S. Cl. ..... 343/700 MS; 343/702; 343/846

(58) Field of Classification Search ..... 343/700 MS, 343/702, 767, 846, 893
See application file for complete search history.

(56) References Cited

U.S. PATENT DOCUMENTS 6,897,810 B2 * 5/2005 Dai et al. ..... 343/700 MS
7,136,025 B2 * 11/2006 Lin et al. ..... 343/770
2005/0259024 A1 * 11/2005 Hung et al. ..... 343/770
2007/0188384 A1 * 8/2007 Liu ..... 343/700 MS

* cited by examiner

*Primary Examiner*—Shih-Chao Chen
(74) *Attorney, Agent, or Firm*—WPAT, P.C.; Anthony King

(57) ABSTRACT

A multi-band antenna operates at a low frequency and a wider high frequency bands, which is formed as an elongated shape defining opposite ends. The multi-band antenna has a slot opened at a long edge and being extending to one end thereon. The wide range of the opening of the slot is larger than the extension length of the slot. A feeding conductor with a feeding point is arranged to adjoin the opening of the slot. The multi-band antenna resonates the low frequency band and a first high frequency. The slot obtains a second high frequency band higher than and partially overlapped the first high frequency. So the multi-band antenna has the low frequency bands and the better high frequency which includes several high frequency bands.

20 Claims, 4 Drawing Sheets

MULTI-BAND ANTENNA

BACKGROUND OF THE INVENTION

1. Field of the Invention

The invention relates to a multi-band antenna and more specifically, to a multi-band antenna for using in a portable electrical device, such as a notebook.

2. The Related Art

Wireless communication systems continue to grow in popularity and have become an integral part of both personal and business communications. There is a growing need for multi-band antennas for use in wireless communication devices to adapt the wireless communication devices for multi-bands operation. A convention antenna configured in the wireless communication devises such as mobile phones and personal digital assistants, can send and receive four bands wireless signal such as GSM850 (Global System for Mobile communications), EGSM (Extended Global System for Mobile communications), DCS1800 (Digital Cellular System) and PCS1900 (Personal Conferencing Specification). It is necessary for an antenna adapts to configured in the wireless communication devices, which operates at various wireless communication bands further comprising W-CDMA2100 (Wideband Code Division Multiple Access), Wi-Fi (Wireless Fidelity) and etc.

SUMMARY OF THE INVENTION

An object of the present invention is to provide a multi-band antenna having a first low frequency band including GSM850 and EGSM900 bands and a wider high frequency band including DCS1800, PCS1900 and W-CDMA2100 bands.

According to the invention, the multi-band antenna is formed as an elongated shape defining opposite ends. A slot opens at a long edge of the multi-band antenna and extends to one of the ends of the multi-band antenna. A wide range of the slot is larger than an extension length of slot. A feeding conductor is arranged to adjoin an opening of the slot. A feeding point is arranged at the free end of the feeding conductor.

The multi-band antenna is divided into a first portion with the slot and a second portion, seen from the first feeding conductor. The first portion obtains an electrical resonance length of a quarter wavelength corresponding to the low frequency band and the second portion obtains an electrical resonance length of a quarter wavelength corresponding to a first high frequency band. Furthermore, the slot obtains a second high frequency band higher than and partially overlapped the first high frequency band. So the multi-band antenna has a low frequency band including GSM850 and EGSM900 bands and the wider high frequency having the first and second high frequency bands including DCS1800, PCS1900 and W-CDMA2100 bands.

Another object of the present invention is to provide a multi-band antenna having GSM850, EGSM900, DCS1800, PCS1900, W-CDMA2100 and Wi-Fi (2.4 GHz) bands.

According to the invention, the multi-band antenna has a first radiating element, a second radiating element spaced from the first radiating element, a first ground portion and a second ground portion. The first ground and the second ground are independently each other.

The first radiating element is formed as an elongated shape defining opposite ends. A slot opens at a long edge of the first radiating element and extends to one of the ends of the first radiating element. A wide range of the slot is shorter than an extension length of slot. A first feeding conductor is arranged to adjoin the opening of the slot. A first feeding point is arranged at the free end of the first feeding conductor.

The second radiating element is a planar inverted-F antenna having an elongated radiating conductor, a second feeding conductor extending from one end of the elongated radiating conductor, a second feeding point arranged at the feed end of the second feeding conductor and a short conductor spaced from the second feeding conductor and connected the second ground portion and the elongated radiating conductor.

The first radiating element is divided into a second portion with the slot and a third portion, seen from the first feeding conductor. The second portion obtains an electrical resonance length of a quarter wavelength corresponding to GSM850 and EGSM900 bands and the third portion obtains an electrical resonance length of a quarter wavelength corresponding to DCS1800, PCS1900 and W-CDMA2100 bands. Further, the second radiating element obtains an electrical resonance length of a quarter wavelength corresponding to Wi-Fi (2.4 GHz) band.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
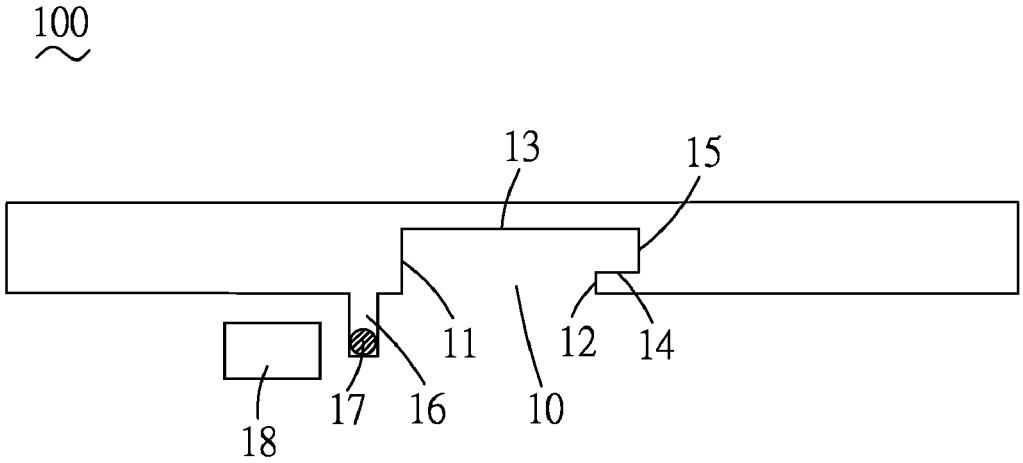
FIG. 1 shows the a first preferred embodiment of a multi-bands antenna structure according to the present invention.

Please refer to FIG. 1, showing a first preferred embodiment of a multi-band antenna 100 according to the present invention. The multi-band antenna 100 is made of metallic substances for example, making from a metal foil, printing on a printed circuit board and etc.

The multi-band antenna 100 is substantially formed as an elongated shape defining opposite ends. The multi-band antenna 100 has a first slot 10 opened at a long edge thereon. The slot 10 is defined by several sides. Both a first side 11 and a second side 12 which is shorter than the first side 11, define the opening of the slot 10. A third side 13 and a fourth side 14 extend from the first side 11 and the second side 12 respectively. The third side 13 is longer than the fourth side 14. A fifth side 15 connects the third side 13 and the fourth side 14.

In this embodiment, one end of the first side 11 and the second side 12 connects the long edge of the multi-band antenna 100 respectively, the other end of the first side 11 and the second side 12 extends to opposite long edge and connects the third side 13 and the fourth side 14 respectively. The first side 11 and the second side 12 are perpendicular to the long edge of the multi-band antenna 100 respectively. One end of the third side 13 and the fourth side 14 connects the first side 11 and the second side 12 respectively, the other end of the third side 13 and the fourth side 14 extends to one end of the multi-band antenna 100 and connects both ends of the fifth side 15.

The third side 13 is perpendicular to the first side 11 and the fifth side 15 respectively. The fourth side 14 is perpendicular to the second side 12 and the fifth side 15 respectively. The length between the first and second sides 11, 12 is longer than the length of the fourth side 14. A feeding conductor 16 with a feeding point 17 extends from the long edge where the slot 10 opened. The feeding conductor 16 is arranged to adjoin the first side 11 of the slot 10. The feeding point 17 is arranged at the free end of the feeding conductor 16.

Figure 2:
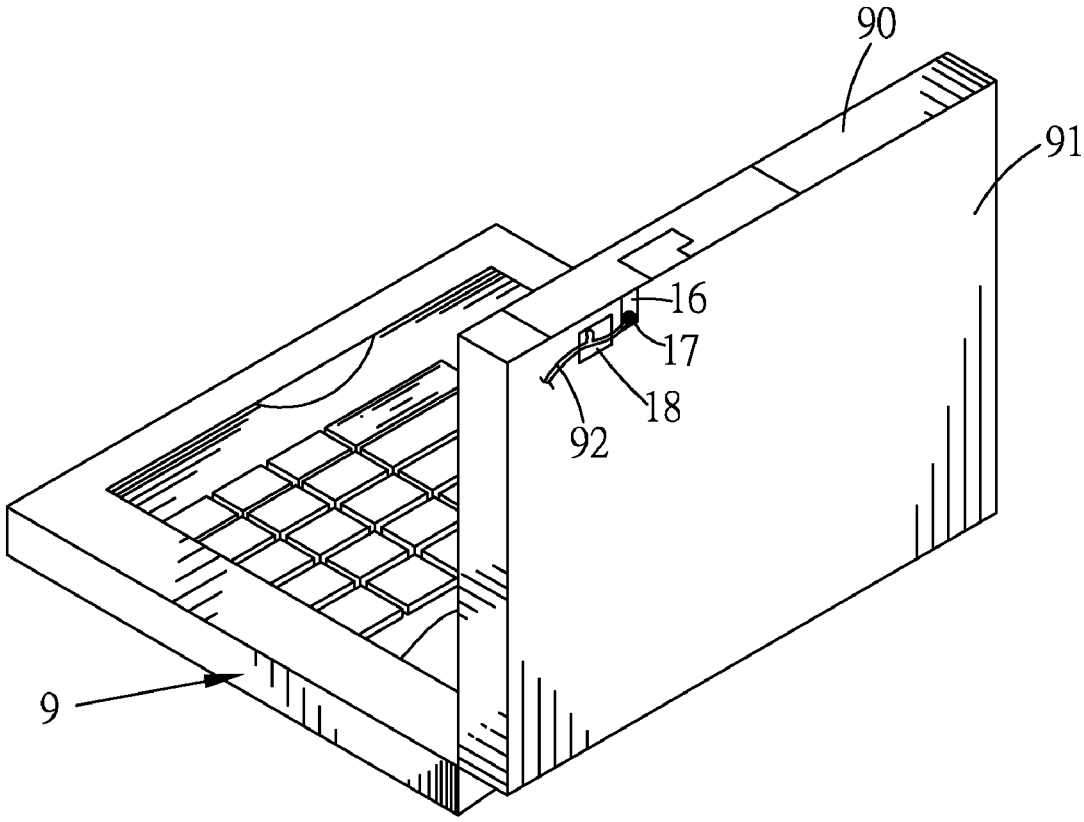
FIG. 2 illustrates the first preferred embodiment of the multi-bands antenna structure configured in a notebook.

Referring to FIG. 2, the multi-band antenna 100 adapts to configure in a portable electronic device, and particular a notebook 9. The multi-band antenna 100 is folded for locating on different surfaces of the notebook 9. In this case, the multi-band antenna 100 is substantially located on the top of a display 90 of the notebook 9 except the feeding conductor 16 located on the back surface of a display 91 of the notebook 9. The notebook 9 sends and receives wireless signal through the multi-band antenna 100 and a cable 92 connected the feeding point 17 and a first ground portion 18 spaced from the feeding conductor 16.

In this embodiment, the multi-band antenna 100 is divided into a first portion with the slot 10 and a second portion, seen from the feeding conductor 16. The first portion obtains an electrical resonance length of a quarter wavelength corresponding to a low frequency band having GSM850 and EGSM900 bands. The second portion obtains an electrical resonance length of a quarter wavelength corresponding a first high frequency band having DCS1800, PCS1900 and W-CDMA2100 bands. The slot 10 further obtains a second high frequency band which is higher than the first high frequency band and partially overlapped the first high frequency band.

According to design of the slot 10 for example, where slot 10 is opened and extended, a wide range of the opening of the slot 10 and extension length of the slot 10, and where the feeding conductor 16 extends from, the multi-band antenna 100 has the low frequency band having GSM850 and EGSM900 bands, and a wider high frequency band which includes the first high frequency band and the second high frequency band, has DCS1800, PCS1900 and W-CDMA2100 bands.

Figure 3:
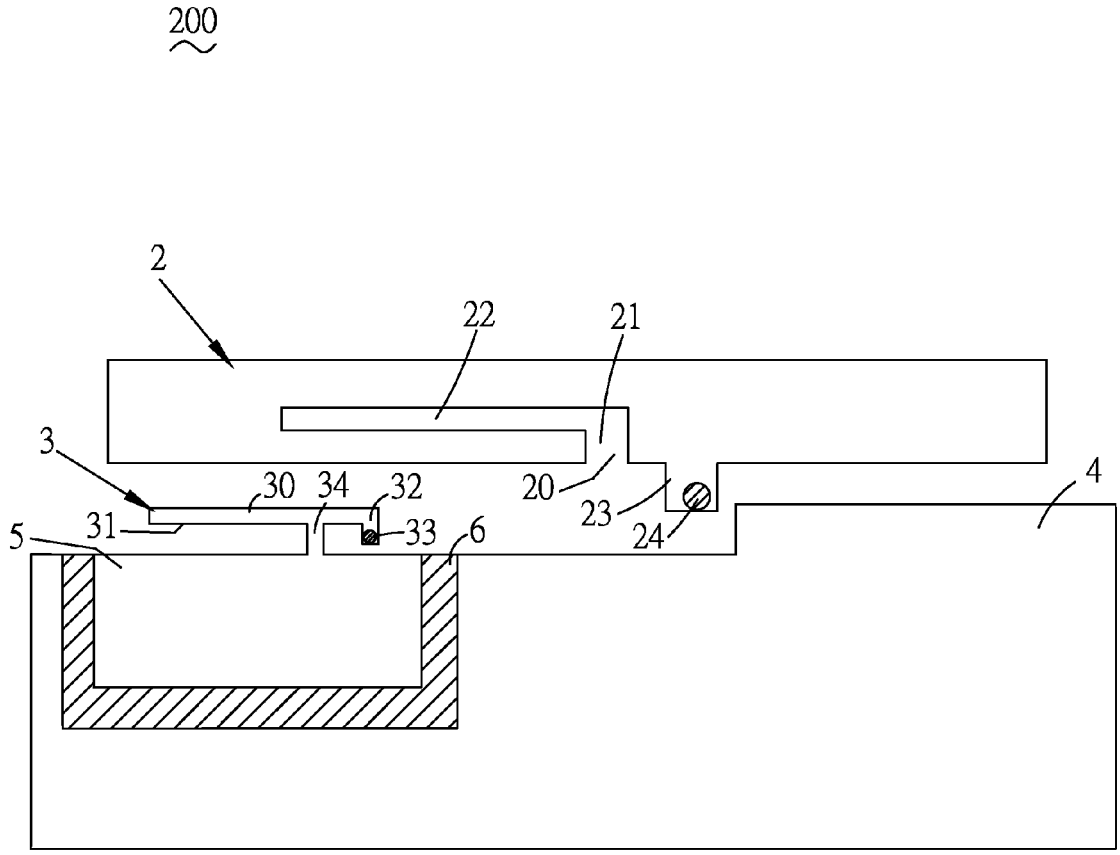
FIG. 3 shows the second preferred embodiment of a multi-bands antenna structure according to the present invention.

As shown in FIG. 3. A second preferred embodiment of a multi-band antenna 200 according to the present invention. The multi-band antenna 200 has a first radiating element 2, a second radiating element 3 spaced from the first radiating element 2, a first ground portion 4 and a second ground portion 5. The first ground portion 4 and the second ground portion 5 are independently each other.

The first radiating element 2 is substantially formed as an elongated shape defining opposite ends. The first radiating element 2 has a slot 20 opened at a long edge thereon. The slot 20 has an opening portion 21 opened at the long edge of the first radiating element 2 and an extension portion 22 being extended from the close end of the opening portion 21. In this embodiment, the extension portion 22 substantially perpendicular to the opening portion 21 extends to one end of first radiating element 2. The wide range of the opening portion 21 is shorter than the length of the extension portion 22.

A first feeding conductor 23 extends from the long edge of first radiating element 2 where the slot 20 opened. The first feeding conductor 23 is arranged to adjoin the opening portion 21 of the slot 20. A first feeding point 24 is arranged at the free end of the first feeding conductor 23. The first element 2 is divided into a second portion with the slot 20 and a third portion, seem from the first feeding conductor 23.

In this embodiment, the second portion obtains an electrical resonance length of a quarter wavelength corresponding to a low frequency band having GSM850 and EGSM900 bands. The third portion obtains an electrical resonance length of a quarter wavelength corresponding a third high frequency band having DCS1800, PCS1900 and W-CDMA2100 bands.

Still referring to FIG. 3, the second radiating element 3 is a planar inverted-F antenna (PIFA) spaced from the first radiating element 2. In this case, the second radiating element 3 is arranged to adjoin the long edge of the first element 2 where the slot 20 opened and near the second portion of the first radiating element 2. The second radiating element 3 has an elongated radiating conductor 30 with an outer long edge 31, a second feeding conductor 32 extending from one end of the elongated radiating conductor 30, a second feeding point 33 arranged at the feed end of the second feeding conductor 32 and a short conductor 34 spaced from the second feeding conductor 32 and connected the elongated radiating conductor 30 and the second ground portion 5.

In this embodiment, the elongated radiating conductor 30 is substantially parallel to the long edge of first radiating element 2 wherein the slot 20 opened, the second feeding conductor 32 and the short conductor 34 extend from the outer long edge 31 of the elongated radiating conductor 30. Seen from the first feeding conductor 23 of the first radiating element 2 there is first the opening portion 21 of the slot 20, then the second feeding conductor 32 of the second radiating element 3, and then the short conductor 34 of the second radiating element 3. The second radiating element 3 obtains an electrical resonance length of a quarter wavelength corresponding to a fourth high frequency band having Wi-Fi (2.4 GHz) band.

Figure 4:
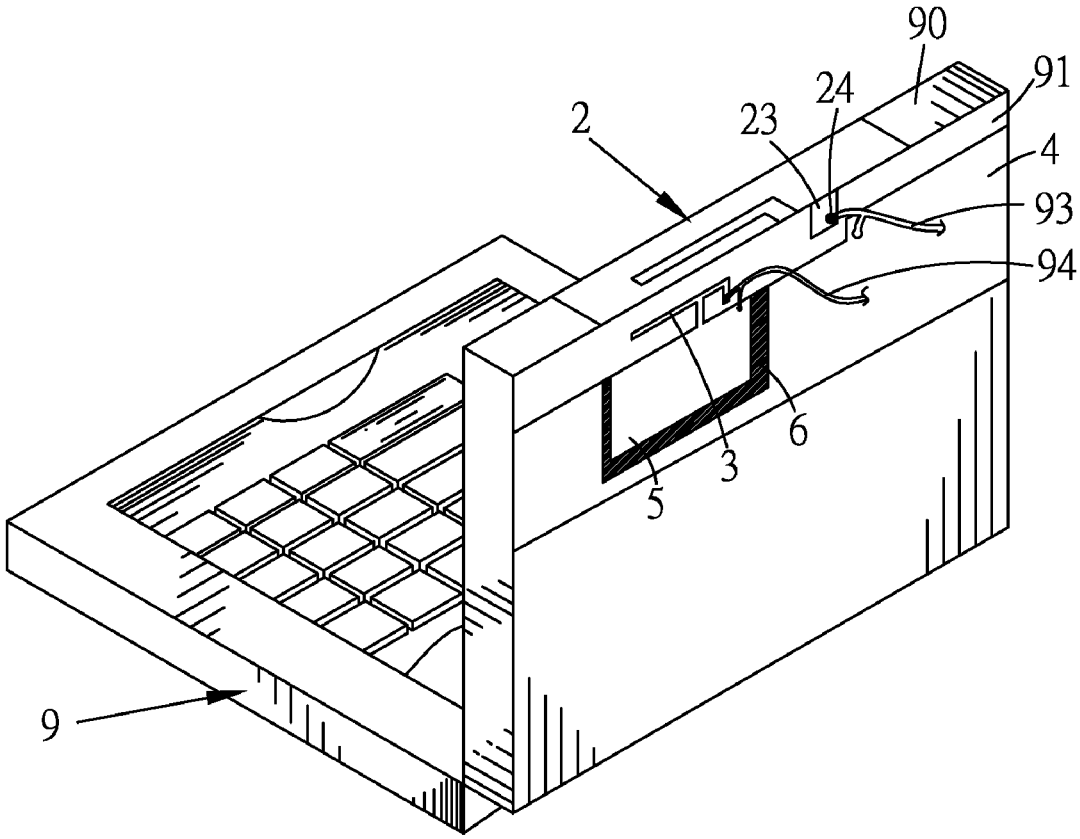
FIG. 4 illustrates the second preferred embodiment of the multi-bands antenna structure configured in the notebook.

Shown in FIG. 4, the multi-band antenna 200 is also folded for located on the different surfaces of the notebook 9. In this embodiment, the first radiating element 2 is substantially located on the top of the display 90 of the notebook 9 except the first feeding conductor 23 located on the back surface of the display 91 of the notebook 9. The second radiating element 3 is also located on the back surface of the display 91 of the notebook 9. In this case, the first ground portion 4 is the ground of the notebook 9. The second ground portion 5 is located on the first portion 4 and an insulating material 6 is arranged between the first ground 4 and the second ground 5. The notebook 9 operates the multi-band antenna 200 through a first cable 93 connected the first feeding point 24 of the first radiating element 2 and a first ground portion 4, and a second cable 94 connected the second feeding point 32 of the second radiating element 3 and a second ground portion 5.

According to design of the slot 20 and where the first feeding conductor 23 extends from, the first radiating element 2 has the second low frequency band including GSM850 and EGSM900 bands, and the third high frequency band including DCS1800, PCS1900 and W-CDMA2100 bands. Furthermore, according to design of the second radiating element 3, the second radiating element 3 has the fourth high frequency band including Wi-Fi (2.4 GHz) band. According to relation position between the first radiating element 2 and the second radiating element 3, the second low frequency band and the third high frequency band of the first radiating element 2, and the fourth high frequency band of the second radiating element 3 obtain a preferred gain respectively.

Furthermore, the present invention is not limited to the embodiments described above; various additions, alterations and the like may be made within the scope of the present invention by a person skilled in the art. For example, respective embodiments may be appropriately combined.

What is claimed is:

1. A multi-band antenna substantially formed as an elongated shape having opposite ends comprising:

a slot opened at a long edge of said multi-band antenna, extending to one of said ends;

a feeding conductor arranged at the long edge where said slot is opened; and a feeding point arranged at the free end of said feeding conductor, wherein said slot is defined by a first side arranged to adjoin said feeding conductor, a second side shorter than said first side, said first and second sides define the opening of said slot, a third side extends from said first side, a fourth side shorter than said third side extends from said second side and a fifth side connects said third side and said fourth side.

2. The multi-band antenna as claimed in claim 1, wherein said first side and said second side are perpendicular to said long edge of said multi-band antenna respectively, said third side and said fourth side are perpendicular to said first side and said second side, said fifth side is perpendicular to said third side and said fourth side.

3. The multi-band antenna as claimed in claim 1, wherein said multi-band antenna is folded for locating on different surfaces of a portable electronic device.

4. The multi-band antenna as claimed in claim 3, wherein said portable electrical device is a notebook, said multi-band antenna is substantially located on the top of a display of said notebook except said feeding conductor located on the back surface of said display of said notebook, said notebook operates said multi-band antenna through a cable connected said feeding point and a ground portion spaced from said feeding conductor.

5. The multi-band antenna as claimed in claim 1, wherein the multi-band antenna obtains a low frequency band, a first high frequency band and a second high frequency band produced through said slot, said second high frequency band is higher than said first high frequency band and partially overlapped said first high frequency band.

6. A multi-band antenna comprising:

a first radiating element substantially defined opposite ends having a slot which is opened at a long edge thereon, extending to one of said ends, and a first feeding conductor with a first feeding point arranged to adjoin said slot;

a second radiating element substantially formed as a planar inverted-F antenna which is spaced from said first radiating element having an elongated radiating conductor defining an outer long edge, a second feeding conductor with a second feeding point extending from one end of said elongated radiating conductor, a short conductor spaced from said second feeding conductor and connected said elongated radiating conductor;

a first ground portion spaced from said first feeding conductor; and a second ground portion connected said short conductor, said first ground portion and said second ground portion being independently each other.

7. The multi-band antenna as claimed in claim 6, wherein said slot having an opening portion opened at said long edge of said first radiating element and an extension portion extending from the close end of said opening portion, the wide range of said opening portion is shorter than the length of said extension portion.

8. The multi-band antenna as claimed in claim 7, wherein said first feeding point is arranged at the free end of said first feeding conductor.

9. The multi-band antenna as claimed in claim 8, wherein said elongated radiating conductor of said second radiating element is substantially parallel to said long edge of said first radiating element where said slot opened, said second feeding conductor and said short conductor extend from said outer long edge of said second radiating element.

10. The multi-band antenna as claimed in claim 9, wherein said multi-band antenna is folded for located on different surfaces of a portable electronic device.

11. The multi-band antenna as claimed in claim 10, wherein said portable electrical device is a notebook, said first radiating element is substantially located on the top of a display of said notebook except said first feeding conductor located on the back surface of said display of said notebook, said second radiating element is located on said back surface of said display of said notebook, said notebook operates said multi-band antenna through a first cable connected said first feeding point and said first ground portion, and a second cable connected said second feeding conductor and said second ground portion.

12. The multi-band antenna as claimed in claim 11, wherein said first ground portion is the ground of said notebook, an insulating material is located on said first ground portion, said second ground portion is located on said insulating material.

13. A multi-band antenna comprising:

a first radiating element having a slot and a first feeding conductor with a first feeding point arranged to adjoin said slot;

a planar inverted-F antenna having a second feeding conductor with a second feeding point and a short conductor spaced from said second feeding conductor;

a first ground portion spaced from said first feeding conductor; and a second ground portion connected said short conductor of said planar inverted-F antenna, said first ground portion and said second ground portion being independently each other.

14. The multi-band antenna as claimed in claim 13, wherein said first radiating element is formed as an elongated shape defining opposite ends, said slot opens at a long edge of said first radiating element and extends to one of said ends.

15. The multi-band antenna as claimed in claim 14, wherein said slot having an opening portion opened at said long edge of said first radiating element and an extension portion extending from the close end of said opening portion, the wide range of said opening portion is shorter than the length of said extension portion.

16. The multi-band antenna as claimed in claim 15, wherein said first feeding point is arranged at the free end of said first feeding conductor.

17. The multi-band antenna as claimed in claim 13, wherein said planar inverted-F antenna has an elongated radiating conductor, said second feeding conductor extends from one end of said elongated radiating conductor, said short conductor connects said elongated radiating conductor and said second ground portion.

18. The multi-band antenna as claimed in claim 13, wherein said multi-band antenna is folded for locating on different surfaces of a portable electronic device.

19. The multi-band antenna as claimed in claim 18, wherein said portable electrical device is a notebook, said first radiating element is substantially located on the top of a display of said notebook except said first feeding conductor located on the back surface of said display of said notebook, said planar inverted-F antenna is located on said back surface of said display of said notebook, said notebook operates said multi-band antenna through a first cable connected said first feeding point and said first ground portion, and a second cable connected said second feeding point and said second ground portion.

20. The multi-band antenna as claimed in claim 19, wherein said first ground portion is the ground of said notebook, an insulating material is located on said first ground portion, said second ground portion is located on said insulating material.

* * * * *